United States Patent [19]

Arai

[11] 4,184,102

[45] Jan. 15, 1980

[54] FLASHING AND SOUND GENERATING LAMP

[75] Inventor: Hiroshi Arai, Tokyo, Japan

[73] Assignee: Nippon Lissajou Co., Ltd., Tokyo, Japan

[21] Appl. No.: 903,303

[22] Filed: May 5, 1978

[51] Int. Cl.[2] ..... H01J 7/44; H01J 17/34; H01J 29/96; H01K 1/62

[52] U.S. Cl. ..... 315/47; 315/50; 315/72

[58] Field of Search ..... 315/46, 47, 50, 72, 315/100

[56] References Cited

U.S. PATENT DOCUMENTS

| | | | |
|---|---|---|---|
| 2,044,256 | 6/1936 | Nothstine | 315/72 |
| 2,790,933 | 4/1957 | Wiswell | 315/72 |
| 2,901,667 | 8/1959 | Kotsch et al. | 315/72 |
| 3,416,029 | 12/1968 | Griffith et al. | 315/100 X |

FOREIGN PATENT DOCUMENTS

| | | | |
|---|---|---|---|
| 832353 | 6/1938 | France | 315/72 |

*Primary Examiner*—Saxfield Chatmon, Jr.
*Attorney, Agent, or Firm*—Pollock, VandeSande and Priddy

[57] ABSTRACT

A flashing and sound generating lamp that repeats on-off operation and generates a characteristic audible sound when an electric current is supplied to the lamp. The lamp comprises a thermally bendable member connected in series or in parallel with the lamp filament to effect on-off energization of the filament as a result of the bending of the member due to the presence and absence of radiant heat from the filament, and a concavity is prefabricated into the thermally bendable member to cause the member to bend with a snap action thereby to generate a characteristic sound each time the lamp is turned on and off.

6 Claims, 7 Drawing Figures

FLASHING AND SOUND GENERATING LAMP

THE FIELD OF THE INVENTION

This invention relates to a flashing and sound generating lamp which repeats an on-off operation with a certain repetition cycle when supplied with a current, and which generates a particular audible sound during the flashing of the lamp.

Decorative lamps, such as those used on Christmas Day, have been suggested heretofore wherein the lamps have a bimetal connected in series or in parallel with a lamp filament which radiates heat on carrying current so that the bimetal is deformed to interrupt the current through the filament, and thus repeats the on-off operation of the lamp and gives pleasure to the viewers.

SUMMARY OF THE INVENTION

The purpose of this invention is to provide a lamp of the general type described above wherein, however, the lamp, and more particularly the bimetal therein, is so constructed that the lamp generates a particular audible sound as the lamp flashes repeatedly in the presence of current.

DETAILED DESCRIPTION OF THE INVENTION

Figure 1:
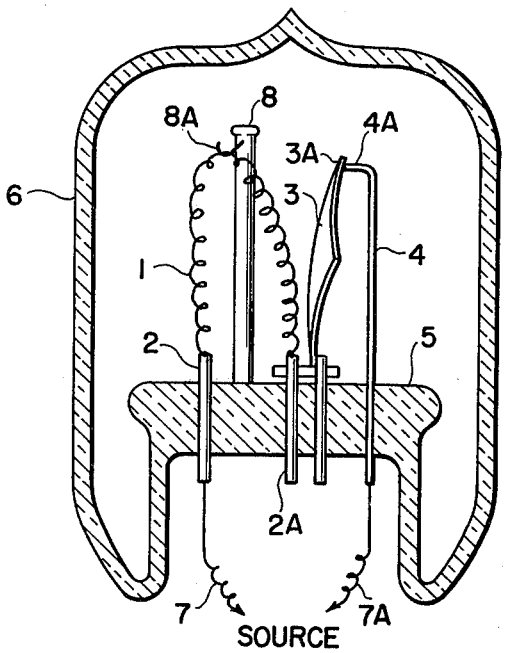
FIG. 1 is a partly diagrammatic sectional view of a first embodiment of this invention.

FIG. 1 is a partly cross sectional view of the first embodiment of this invention. In the figure, the lamp is filled with an inert gas or is evacuated. The lamp comprises: a filament 1, through-conductors 2 and 2A supported by a glass base 5, a thermally bendable member 3 adapted to be deformed with temperature variation, a contact rod 4 having a contact part 4A at its top, a glass enclosure 6 for the lamp, lead wires 7 and 7a, a glass support 8 held on the base 5, and a filament supporting hook 8A fixed on the glass support 8. Both electrical and mechanical connections are made between the conductor 2A and the lower end of the thermally bendable member 3. The upper end 3A of the member 3 bends into electrical connection with the contact 4A at lower temperatures and, as the temperature of member 3 increases, bends in the opposite direction to disengage from contact 4A. The term 'thermally bendable member' used in this specification and in the appended claims contemplates every member made of resistive or conductive materials yielding a large and comparatively abrupt bending distortion when subjected to varying temperature —for example trimetal and bimetal members having a special structural configuration and/or shape which provides a temperature-stress hysteresis characteristic of the type shown in FIG. 5. A circular or a rectangular thin plate concaved to form a part of sphere, or a plate with a pitted center is suitable for use as the thermally bendable member of this invention. In practice, the side of the bimetal member having the larger thermal expansion coefficient must be at the inside of the concavity at normal temperature.

Figure 3:
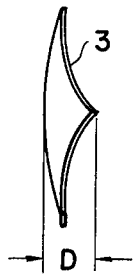
FIG. 3 is the side view of the thermally bendable member shown in FIG. 2.
Figure 2:
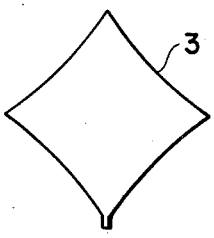
FIG. 2 is a plan view of an example of the thermally bendable member employed in this invention.
Figure 5:
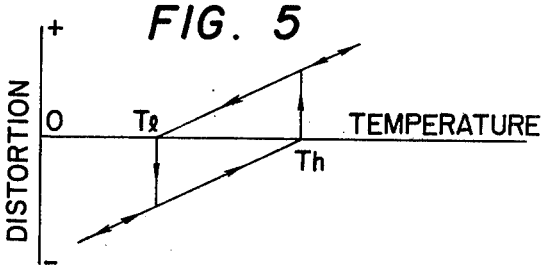
FIG. 5 illustrate a temperature-distortion characteristic of the thermally bendable member.

FIG. 2 is a front view of a suitable thermally bendable member nearly square in shape and curved spherically, employed in this invention, illustrating the shape of said member at room temperature. FIG. 3 is the cross sectional view of the thermally bendable member shown in FIG. 2. Bimetals of various materials suitable in quality and thickness for the thermally bendable member of this invention are on the market. In an experiment, the inventors employed a bimetallic plate of square or rectangular configuration 0.15 mm in thickness and 10—20 mm in length along each side as the thermally bendable member, the plate being curved concavely at normal temperature along each of two orthogonal lines extending respectively between the opposing vertices of the plate as shown in FIG. 3. FIG. 5 shows the temperature-distortion characteristic of the member in question; abrupt or snap-action changes in distortion in opposite directions respectively occur at the temperatures Tl and Th where the distortion of the bimetallic plate becomes nearly zero, i.e., where the normally concave member has been distorted by temperature variation into a nearly flat configuration, and cause vibration.

Figure 4:
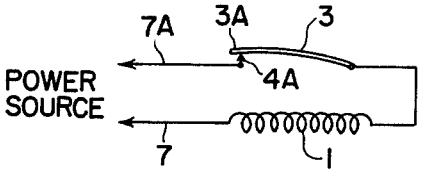
FIG. 4 shows an electric circuit of the device of FIG. 1.

FIG. 4 shows an electric equivalent circuit of the lamp of the FIG. 1 embodiment of this invention. The bimetal 3 is in contact with the contact part 4A formed at the top of contact rod 4 when the filament 1 carries no current and the bimetal is not heated. In this state the amount of distortion of concave member 3 is D as shown in FIG. 3. When an AC or DC power supply is connected to the lead wires 7 and 7A, a current flows from lead wire 7A through contact rod 4, contact part 4A, bimetal 3, conductor 2A, filament 1 and conductor 2 to the lead wire 7, and the filament 1 is energized and emits light. This results in a rise of filament temperature. The heat is transferred to the bimetal 3 mainly by radiation to raise its temperature. The rise in temperature of the bimetal 3 gradually decreases the distortion D of FIG. 3 as shown in FIG. 5. At the temperature Th where the distortion becomes nearly zero, an abrupt change in distortion occurs cause the bimetal 3 to snap from its flattened configuration into a concave shape in the opposite direction, i.e., the bimetals 3 is suddenly bent backward and causes vibration. The vibration is transferred from the conductor 2A through the glass base 5 to the external wall of the glass enclosure 6, producing an audible sound. If the inside of the glass enclosure 6 is filled with an inert gas, the vibration propagates through the gas to the wall and produces a sound at the outside of the wall. The frequency of the sound depends on the size, material and other factors of the bimetal. The glass external wall 6 serves as a resonator so that it has the advantage of raising the loundness of the sound. The departure of the top end 3A of the bimetal from the contact 4A, interrupts the current through the filament 1, and stops radiation of heat from it to the bimetal 3, cooling the bimetal. As shown in FIG. 5, when the temperature falls to T1 at which the distortion D of the bimetal 3 becomes approximately zero, the bimetal snaps into its original configuration and the sound is generated in the same manner as described previously, and the top 3A of the bimetal again comes in contact with the contact rod 4 so that a current flows once more through the filament. Thus, the on-off operation of the lamp and the bending of the bimetal are repeated cyclically, and the sound which characterizes the lamp of the present invention is generated intermittently in accordance with the bending of the bimetal. The inventor has verified by experiment that the sound is large enough to be heard, and that the generated on cooling of the bimetal is larger than that on heating thereof.

Figure 6:
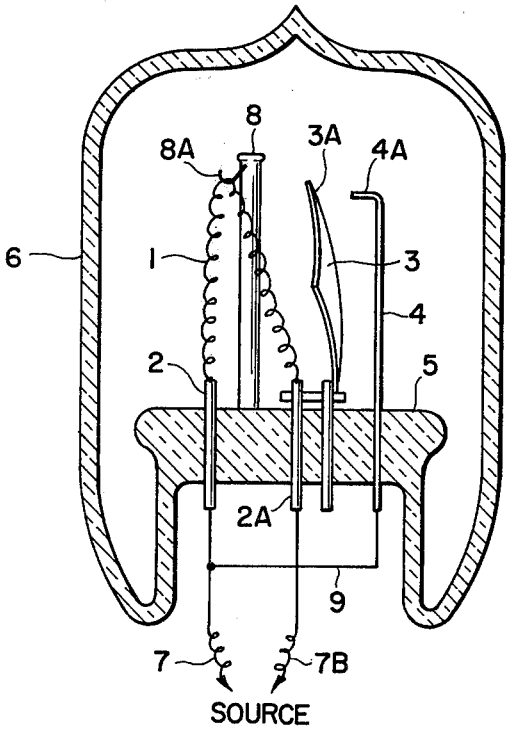
FIG. 6 is a partly diagrammatic sectional view of a second embodiment of this invention.
Figure 7:
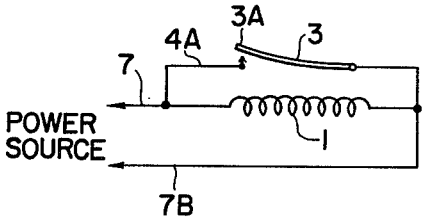
FIG. 7 shows an electric circuit of the device of FIG. 6.

FIG. 6 is a cross sectional view of another embodiment of this invention, and FIG. 7 is the equivalent electric circuit. The same symbols as those in FIG. 1 indicate the same or equivalent parts. In this embodiment, the contact rod 4 is connected to the conductor 2 through the lead wire 9, and the top end 3A of the thermally bendable member 3 is away from the contact 4A at room temperature. When the two conductors 2 and 2A are connected to an AC or DC power supply through lead wires 7 and 7B and other impedances (e.g. other lamps), a current flows through the filament and heats it. The radiated heat from the filament 1 gradually reduces the degree of the bending of the thermally bendable member. At the moment when the deviation reaches nearly zero, the thermally bendable member 3 suddenly bends in a snap-action in the opposite direction so that the top 3A of the member 3 comes in contact with the contact part 4A, short-circuiting the filament 1. This results in the extinction of the lamp and hence the thermally bendable member 3 is cooled because of the absence of heat radiation. As mentioned hereinbefore when the member 3 has cooled sufficiently, an abrupt change in the shape of said member occurs in the vicinity of zero distortion, the top 3A leaving the contact part 4A, and the previous condition is recovered. The thermally bent member radiates a particular sound to the outside of the lamp each time it snaps in one or the other direction.

As is described above, the lamp of this invention is characterized by the generation of a particular sound which is determined by the internal constituent materials of member 3 and which is produced with the periodic flash of the lamp. Therefore, the lamp will have a variety of useful applications in practice. An increased acoustical effect is brought about by combining several lamps different in loundness and tone depending upon the size and shape of the bimetal employed.

What we claim is:

1. In a flashing incandescent lamp of the type comprising an envelope containing a filament, and circuit means within the envelope for controlling the energization of the filament in a periodic fashion, said circuit means including an electrical contact and a thermally bendable member disposed adjacent said filament and thermally responsive to the presence and absence of radiant heat from said filament for bending of said member into and out of engagement with said contact, the improvement wherein said thermally bendable member comprises electrically conductive member shaped to exhibit a snap-action temperature-stress hysteresis characteristic operative to generate vibrations which produce a characteristic audible sound from said lamp as said member snaps in opposing directions of bending between two predetermined extreme positions in response to the heating or cooling of said member to two different predetermined temperatures respectively, said thermally bendable member being in engagement with said electrical contact until the temperature of said member is changed to one of said predetermined temperatures, and being thereafter spaced from said electrical contact until the temperature of said member is changed to the other of said predetermined temperatures.

2. The improvement of claim 1 wherein said thermally bendable member comprises a thin substantially rectangular plate which is curved along two lines which extend respectively between the two pairs of opposing vertices of said rectangular plate to give said plate a concave configuration.

3. The improvement of claim 2 wherein said rectangular plate is a substantially square plate, said concave configuration substantially comprising a section of a sphere.

4. The improvement of claim 3 wherein said thermally bendable member is a bimetallic member.

5. The improvement of claim 2 wherein said thermally bendable member and its associated electrical contact comprise an energization control circuit which is in series with said filament, said thermally bendable member being in engagement with said contact at room temperature.

6. The improvement of claim 2 wherein said thermally bendable member and its associated electrical contact comprise an energization control circuit which is disposed in parallel with said filament, said thermally bendable member being spaced from said contact at room temperature.

* * * * *